United States Patent [19]

Wagenseil

[11] Patent Number: 4,852,463

[45] Date of Patent: Aug. 1, 1989

[54] AXIAL PISTON MACHINES WHOSE PISTONS ARE FORMED AS STEPPED PISTONS

[75] Inventor: Ludwig Wagenseil, Vöhringen, Fed. Rep. of Germany

[73] Assignee: Hydromatik GmbH, Fed. Rep. of Germany

[21] Appl. No.: 214,506

[22] Filed: Jul. 1, 1988

[30] Foreign Application Priority Data

Jul. 20, 1987 [DE] Fed. Rep. of Germany ..... 3723988

[51] Int. Cl.[4] ..... F01B 13/04

[52] U.S. Cl. ..... 91/488; 91/499

[58] Field of Search ..... 91/488, 489, 499

[56] References Cited

U.S. PATENT DOCUMENTS 3,106,138 10/1963 Thoma ..... 91/488
3,126,835 3/1964 Kline .
3,142,262 7/1964 Firth et al. ..... 91/488

FOREIGN PATENT DOCUMENTS 707462 6/1941 Fed. Rep. of Germany .

*Primary Examiner*—William L. Freeh
*Attorney, Agent, or Firm*—Scully, Scott, Murphy & Presser

[57] ABSTRACT

An axial piston machine whose pistons are formed as stepped pistons and which bound a first cylinder space and a second cylinder space, wherein the pistons are driven on the driving side via an axially displaceable driving surface on which they slide in a sliding bearing with a pressure pocket which is connected to the first cylinder space by a passage, is arranged so that the loading of the sliding bearings is reduced depending on the operating condition of the axial piston machine. This is achieved by connecting the second cylinder space to a second pressure pocket on one of the two sliding surfaces by a second passage separate from the first passage.

12 Claims, 2 Drawing Sheets

AXIAL PISTON MACHINES WHOSE PISTONS ARE FORMED AS STEPPED PISTONS

TECHNICAL FIELD OF THE INVENTION

The invention relates to an axial piston machine having stepped pistons.

BACKGROUND OF THE INVENTION AND PRIOR ART

It has been proposed for various reasons to form at least one piston of a axial piston machine as a stepped piston, whereby two cylinder spaces are formed. The cylinder spaces can be connected to two throughput lines separated from one another in order, e.g. to divide the throughput volume, cf. U.S. Pat. No. 3,126,835, or else one of the two cylinder spaces can serve merely to press the piston or pistons against an inclined driving surface, or to press a cylinder barrel against the control surface, cf. DE-PS No. 707 462.

In order to improve the sliding bearing between the piston and the driving surface it is known to provide between the sliding surfaces a fluid cushion such as a pressure pocket supplied from the respective cylinder space, which reduces the pressure per unit area and therefore the friction and the wear of the sliding surface both on the piston side and on the driving surface of the sliding bearing, i.e. it brings about a certain reduction in the loading of the sliding bearing.

OBJECT OF THE INVENTION

The object of the invention is to design an axial piston machine having stepped pistons of the kind mentioned in the introduction so that the loading of the sliding bearings is reduced to an extent depending upon the operating condition of the axial piston machine.

BRIEF DESCRIPTION OF THE INVENTION

The invention is based on the discovery that in the known arrangement load dependent hydrostatic bearing support of the piston on the driving face through the fluid pad, i.e. as a function of the axial force with which the piston is pressed against the driving surface, is not possible because no account is taken of the component of pressure that is dependent upon the pressure in the second cylinder chamber. However, the pressure in the first cylinder chamber and that in the second cylinder chamber can both change for various reasons, e.g. in the case of an axial piston machine having two throughput circuits owing to different power requirements of the loads connected thereto.

In the arrangement according to the invention the sliding bearing of the piston on the driving side is provided with a second hydrostatic bearing independent of the first hydrostatic bearing which is connected to the second cylinder chamber by a passage so that its effect depends upon the pressure in the second cylinder chamber. In order to reduce the load on the sliding bearing the actual piston forces are thereby taken into account, which leads to a more balanced hydrostatic bearing support of the piston.

In the case of pistons with three or more steps, a corresponding number of pressure pockets is provided, i.e. a pressure pocket having a separate connecting passage leading to the respective pressure chamber should be provided for each cylinder chamber of the piston.

Within the scope of the invention it is possible to form the hydrostatic bearing according to the invention on the flat sliding surfaces between an inclined disc and a slipper accommodating the piston head and/or between the surface of a spherical piston head and the spherical inner face of a bearing shell or socket accommodating it. Other preferred features of this invention. lead to simple and practicable arrangements which make simple and economical manufacture possible and ensure good operation.

BRIEF DESCRIPTION OF THE DRAWINGS

The invention will now be described in more detail with reference to a preferred exemplary embodiment shown in the drawings, in which.

DETAILED DESCRIPTION OF A PREFERRED EMBODIMENT OF THE INVENTION

Figure 1:
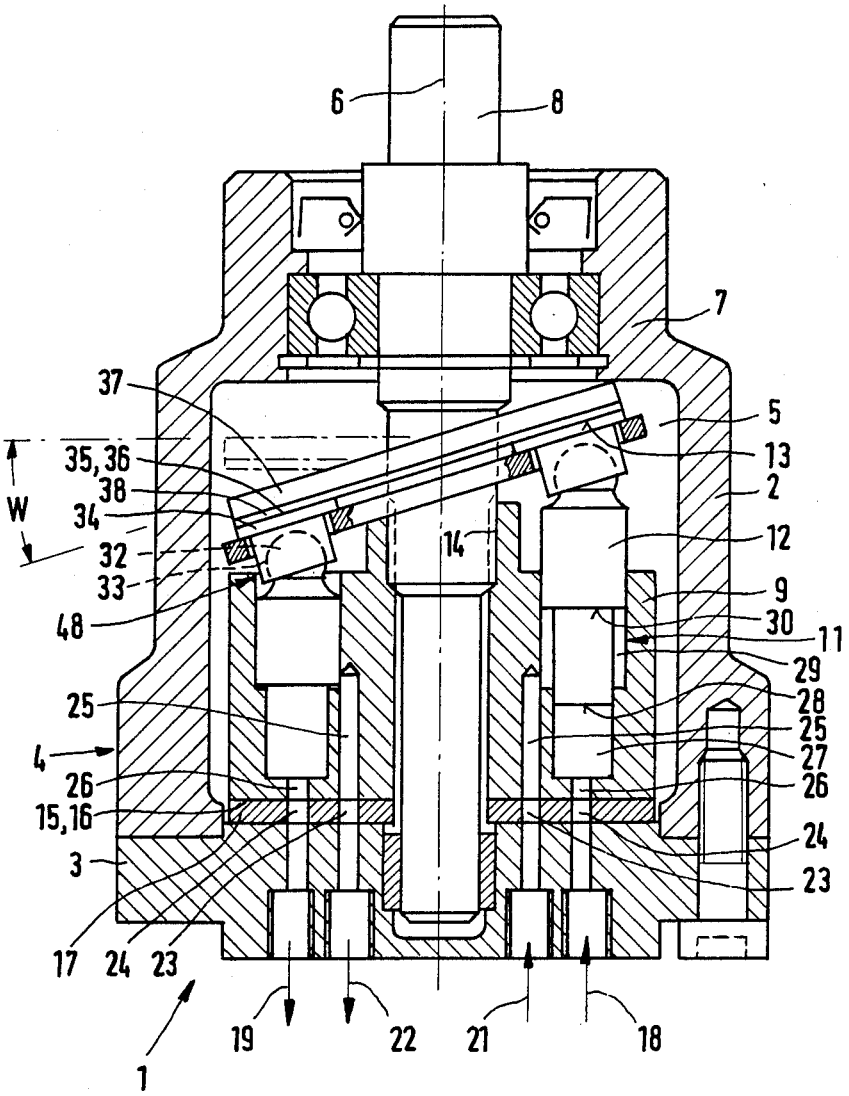
FIG. 1 shows an axial piston machine according to the invention in axial section.
Figure 2:
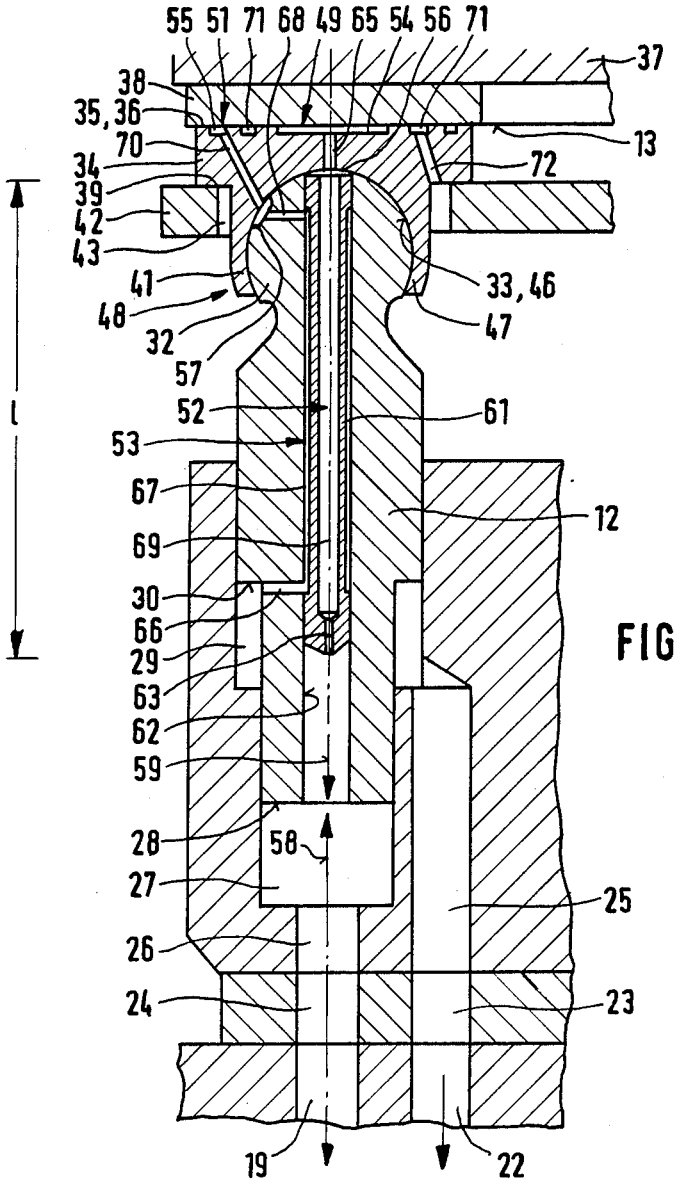
FIG. 2 shows the piston arrangement of the axial piston machine in axial section and on an enlarged scale.

The essential individual parts of the axial piston machine indicated generally by 1 are a housing 4 comprising a pot-like housing part 2 and a housing cover 3, a drive shaft 8 passing through the pot-like housing part 2 or the space 5 within the housing 4 along the centre axis 6, and mounted in the radial wall 7 of the housing part 2 and in the housing cover 3, a cylinder 9 having a plurality of substantial axial piston bores 11, arranged diametrically opposite one another or in a star pattern, in which correspondingly sized pistons 12 are displaceably mounted and can be driven by an axially displaceable sliding surface 13.

In the present exemplary embodiment the cylinder 9 is formed by a cylinder barrel which, by means of a central hole, is arranged on the drive shaft 8 and is rotationally secured thereto by a toothed coupling 14, and with its end 15 facing away from the sliding surface 13 bearing against a control surface 16 formed on a control plate 17 which is secured by screws or centering pins to the housing cover 4 in which two input and output lines 18, 19, 21, 22 for the fluid, in the present case oil, are formed. In the control plate 17 there are two pairs of opposed kidney-shaped control passages 23, 24 which correspond to axial throughput passages 25, 26 which are connected to the piston bores 11 and the inlet or outlet lines 18, 19 21, 22.

The piston bores 11 and the pistons 12 are stepped bores and correspondingly sized stepped pistons, by which first cylinder spaces 27, bounded by the end face 28 of the piston 12, and second cylinder spaces 29 bounded by the stepped surfaces 30 of the piston 12, are formed. In each case the throughput passage 25 opens into the first cylinder space 27 and the second throughput passage 26, located radially inwards from the first throughput passage 25, opens into the second cylinder space 29.

Figure 3:
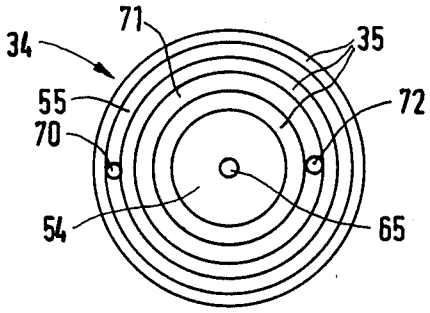
FIG. 3 shows in plan view the sliding surface of a slipper for the piston bearing.

On their driving side the pistons 12 have spherical piston heads 32 which are mounted so as to be pivotable in all directions in the sockets 33 in slippers 34 which engage over and behind the piston heads 32. Flat sliding surfaces 35 on the slippers 34 adjoin the flat inclined surface 36 of an inclined disc 37 which carries on its driving side a slide ring 38 of wear-resistant material and of which the angle w which it makes with a radial transverse plane of the axial piston machine can be altered as desired in order to change the throughput volume of the axial piston machine 1. On their side facing the cylinder 9, the slippers 34 have shoulders 39, and projections 41 containing the sockets 33 pass through holes 43 in a withdrawal plate 42, and with the shoulders 39 abut against the withdrawal plate 42 and can be supported both axially and radially by means of a spherical support head which can be urged axially against the inclined surface 36 (not shown) by means of a pressure spring. In FIG. 3, the inclined disc 37, which can be pivoted in order to alter the throughput volume, is shown for simplicity at right angles to the centre axis 6, i.e. throughput volumes=0 or minimal.

Between the sliding surface 35 of the slipper 34 and the inclined surface 36 of the inclined disc 37 there are in each case hydrostatic bearings indicated generally by 49 and 51 in which fluid or oil cushions, connected to the cylinder spaces 27, 29 by passages 52, 53, act through first and second pressure pockets formed in recesses 54, 55 and act on the respective pistons 12, to an extent depending on the pressures in the cylinder spaces 27, 29, against the piston force shown as an arrow 58 in order to reduce the latter considerably and thereby reduce the friction in the bearings 49, 51. When the piston 12 is supported by means of a slipper 34, with a constant angle of inclination of the inclined surface 36 it is possible to produce a balance between the force of the piston 58 and the resulting reaction 59 of the bearings 49, 51. The balanced bearing condition is possible because the pressure pockets 54, 55 are given an appropriate axially effective size.

Within the scope of the invention it is also possible to arrange third and fourth pressure pockets 56, 57 in at least one of the spherical sliding surfaces 46, 47 which, by suitable connection to the cylinder spaces 27, 29, form hydrostatic bearings for the piston joint 48.

The first passage 52 leading from the first cylinder space 27 and the first and third pressure pockets 54, 56 associated therewith, and the second passage 53 leading from the second cylinder space 29 and the second and fourth pressure pockets 55, 57 associated therewith, form separate pressure systems which are separated from one another by the sliding surfaces 35, 36, 46, 47. As a result the pressure in the respective associated cylinder space 27 or 29 can only act in the respective hydrostatic pads.

In the present exemplary embodiment, a sleeve 61 is inserted axially in a central longitudinal bore 62 in each piston 12 and secured therein, e.g. by compression, adhesion, pining or screwing. The sleeve 61 has an axial passage which is formed by a throttle 63 arranged at its end facing away from the inclined disc 37 and a passage section 69 (bore) having a larger cross-section. At its end facing the piston head 32, the sleeve 61 automatically forms the third pressure pocket 56 by the absence of a spherical shape of its end.

The first passage 52 consists of a section of the longitudinal bore 62, the throttle 63, the passage section 69, the first and third pressure pockets 54, 56 and a passage section 65 in the slipper 34 connecting them to one another.

The second passage 53 consists of a radial passage section 66 in the piston 12 near its stepped face 30, a peripheral groove or narrowing 67 on the sleeve 61, a passage section 68 extending from the peripheral groove 67, in the present case radially, to the spherical zone-shaped fourth pressure pocket 57 and a passage section 70, in this case inclined, connecting the pressure pockets 55, 57 to one another.

In the present exemplary embodiment the third and the fourth pressure pockets 56 and 57 are located in the spherical surface 47 of the piston head 32 and the first and the second pressure pockets 54 and 55 are in the sliding surface 35 of the slipper 34. It is, however, also possible to form the pressure pockets in the respective corresponding sliding surfaces. The peripheral groove 67 and the distance between the passage sections 66 and 68 is smaller than the length l of the sleeve 61, so that the latter has sections at its ends by which it is held completely and securely in the longitudinal bore 62.

The operation of the axial piston machine 1 is generally known and therefore a functional description is omitted. To sum up, it is to be noted that, owing to the better balance between the piston forces 58 and the opposing forces 59, a low-friction and therefore long-life bearing between the slipper 34 and the inclined disc 37 and the piston heads 32 is achieved, and one which depends upon the pressures in each of the cylinder spaces 27, 29, i.e. on the power output of the axial piston machine 1.

In the present exemplary embodiment the first pressure pocket 54 is circular and the second pressure pocket 55 is annular and they are arranged concentric with one another. In order to improve the separation or sealing of the pressure pockets 54, 55 from one another in the present exemplary embodiment an annular groove 71 is arranged between them spaced from each of them and is connected, i.e vented, to the space 5 in the housing 4 by way of a passage 72 extending through the slipper 34.

What is claimed is:

1. An axial piston machine whose pistons are formed as stepped pistons and which bound a first cylinder space and at least a second cylinder space, each cylinder space forming a working chamber and communicating with inlet and outlet ports, wherein the pistons are driven on the driving side via an axially displaceable driving surface on which they slide in a sliding bearing with a pressure pocket which is connected to the first cylinder space by a passage, characterised in that the second cylinder space is connected to a second pressure pocket on one of the two sliding surfaces of the sliding bearing by a second passage separated from the first passage.

2. An axial piston machine according to claim 1, wherein the first and second pressure pockets are formed in the sliding surface of a slipper.

3. An axial piston machine according to claim 1, wherein the first and the second passages run, at least on a longitudinal section of the piston, along and through the pistons.

4. An axial piston machine according to claim 3, wherein the passages run coaxially with one another.

5. An axial piston machine according to claim 3, wherein at least one of said first and second passages runs in a sleeve inserted in the piston or is bounded thereby.

6. An axial piston machine according to claim 5, wherein the second passage, in the region of the longitudinal section of the piston, is formed by a recess such as a groove, in particular an annular groove in the peripheral surface of the sleeve.

7. An axial piston machine according to claim 6, wherein the recess in the peripheral surface of the sleeve is linked with at least one of said second cylinder space and said second pressure pocket by at least one of a transverse passage preferably extending near the stepped surface and a transverse passage extending in the region of the piston head.

8. An axial piston machine according to claim 7, wherein at least one of said transverse passages is formed as a throttle or in that a throttle is inserted in said at least one transverse passage.

9. An axial piston machine according to claim 1, wherein the piston has a spherical piston head which is mounted pivotably in a socket in an inclined disc or in a slipper supported so as to slide on said disc, and first and second pressure pockets or a third and a fourth pressure pocket are arranged in at least one of the two spherical sliding surfaces of the piston joint, preferably in the spherical sliding surface of the piston head.

10. An axial piston machine according to claim 9, wherein the second or fourth pressure pocket is concentric with the first or third pressure pocket, preferably surrounding the latter annularly.

11. An axial piston machine according to claim 10 that includes, between the first and the second pressure pockets, a preferably annular recess in one of the sliding surfaces, preferably in that of the slipper, which is connected to the housing space by a passage.

12. An axial piston machine according to claim 5, wherein a throttle is formed in or inserted into the sleeve, preferably at the end of the sleeve facing away from the inclined disc.

* * * * *